US005273388A

United States Patent [19]

Willis et al.

[11] Patent Number: 5,273,388

[45] Date of Patent: Dec. 28, 1993

[54] LIFTING DEVICE FOR DOWN HOLE TUBULARS

[75] Inventors: Clyde A. Willis; Gary T. Oatman, both of Wichita Falls, Tex.

[73] Assignee: W-N Apache Corporation, Wichita Falls, Tex.

[21] Appl. No.: 730,551

[22] Filed: Jul. 16, 1991

[51] Int. Cl.[5] ..... E21B 19/15

[52] U.S. Cl. ..... 414/22.54; 187/8.59; 414/22.62; 414/746.8

[58] Field of Search ..... 187/8.41, 8.59, 27; 414/22.62, 746.8, 22.55, 22.54

[56] References Cited

U.S. PATENT DOCUMENTS

| | | | |
|---|---|---|---|
| 1,417,096 | 5/1922 | Mueller . | |
| 2,900,091 | 8/1959 | Minter | 414/22.62 |
| 2,999,605 | 9/1961 | De Jarnett . | |
| 3,054,514 | 9/1962 | Riley . | |
| 3,288,310 | 11/1966 | Sherman et al. | 414/746.4 |
| 3,515,289 | 6/1970 | Schaller et al. . | |
| 3,630,392 | 12/1971 | Cintract . | |
| 3,682,259 | 8/1972 | Cintract et al. | 414/22.55 X |
| 4,067,453 | 1/1978 | Moller . | |
| 4,708,566 | 11/1987 | Stolzer et al. | 424/746.8 X |

FOREIGN PATENT DOCUMENTS

2721342A1 11/1978 Fed. Rep. of Germany .

OTHER PUBLICATIONS

"Development of Automated Offshore Drilling System" by H. Fujita, M. Sato and N. Shiraishi, Mitsu Engineering & Shipbuilding Co. Ltd.; Y. Wakiya, Japan Ocean Industries Assns.; and S. Tanaka, U. of Tokyo, Copyright 1990, Offshore Technology Conference, presented at the 22nd Annual OTC in Houston, Tex., May 7-10, 1990.

"The Howden Hustler" pp. 11-15 (undated).

"Apache Remote Controlled Semi, or Fully Automated Top Head Drive on Land Offshore Oil & Gas Well Drilling Machines", W-N Apache Corporation, Wichita Falls, Tex. 76307, Catalog No. 188.

"Rig-Automated Drilling: A New Concept is Being Proven", S. J. Houston, Strachan & Henshaw Ltd., Copyright 1991, Offshore Technology Conference, presented at the 23rd Annual OTC in Houston, Tex. May 6-9, 1991.

Patent Application Ser. No. 06/18 1,345, filed Aug. 26, 1980, entitled "Transfer Shoulder for Down-Hole Tubulars", inventors Clyde A. Willis and Howard G. Best.

*Primary Examiner*—Michael S. Huppert
*Assistant Examiner*—Janice Krizek
*Attorney, Agent, or Firm*—Willian, Brinks, Hofer, Gilson & Lione

[57] ABSTRACT

A lifting device for down hole tubulars is used with an earth drilling machine of the type having a boom for moving a down hole tubular from a horizontal position at an intermediate level to a raised position aligned with a drilling axis, and a tubular holding device for holding a down hole tubular horizontally at a lower level, beneath the intermediate level. The lifting device includes first and second spaced, parallel tracks oriented to extend substantially from the lower level substantially to the upper level and first and second dolleys, each guided for movement along a respective one of the tracks and configured to retain the down hole tubular. The dolleys are moved between the lower and intermediate levels by an actuator which is connected to both of the dolleys by a mechanical linkage which includes tension members. This mechanical linkage positively synchronizes movement of the dolleys along the tracks to maintain the tubular horizontal as it is moved between the lower and intermediate levels.

10 Claims, 9 Drawing Sheets

LIFTING DEVICE FOR DOWN HOLE TUBULARS

BACKGROUND OF THE INVENTION

This invention relates to an improved lifting device for down hole tubulars for use in combination with an earth drilling machine of a type having a boom for moving a down hole tubular from a horizontal position at an intermediate level to a raised position aligned with the drilling axis.

Drilling machines of the type described above are known to the art, as disclosed for example in U.S. Pat. Nos. 4,708,581 and 4,407,629. In certain applications it is preferable to pivot the boom about an axis which is elevated a substantial distance above ground level, and above the level at which down hole tubulars are stored near ground level. In the past, lifting devices have been provided for lifting individual lengths of down hole tubular from a lower level (characteristic for example of a pipe rack) and the intermediate level (where the down hole tubular may be loaded into the boom). One prior art system utilizes two hydraulic cylinders, each positioned to lift the tubular at respective positions along the length of the tubular. A flow divider divides the flow of hydraulic fluid between the two cylinders.

One drawback of this prior art approach is that in the event a tubular bears much more heavily on one of the two cylinders, that cylinder may be slower to raise its end of the tubular. If the two cylinders get out of synchronization to any substantial extent, there is a danger that the tubular may slip along its length, thereby mispositioning the tubular and complicating further tubular handling operations.

It is an object of this invention to provide an improved lifting device which overcomes these problems of the prior art.

SUMMARY OF THE INVENTION

According to this invention, an earth drilling machine of the type comprising a boom for moving a down hole tubular from a horizontal position at an intermediate level to a raised position aligned with the drilling axis, and a holding device for holding a down hole tubular horizontally at a lower level, beneath the intermediate level, is provided with a lifting device comprising first and second spaced, parallel tracks oriented to extend substantially from the lower level substantially to the intermediate level, and first and second dolleys, each guided for movement along a respective one of the tracks and configured to retain the down hole tubular. A lifting means is provided for moving the dolleys between the lower and intermediate levels to transfer the tubular between the lower and intermediate levels. The lifting means includes means for positively synchronizing movement of the dolleys along the tracks to maintain the tubular horizontal as the tubular is moved between the lower and intermediate levels.

The preferred embodiments described below utilize a single actuator in the lifting means. These embodiments include means for mechanically linking the lifting actuator with both of the first and second dolleys such that a single actuator moves both dolleys, thereby automatically synchronizing their movement.

The invention itself, together with further objects and attendant advantages, will best be understood by reference to the following detailed description, taken in conjunction with the accompanying drawings.

DETAILED DESCRIPTION OF THE PRESENTLY PREFERRED EMBODIMENTS

Figure 1:
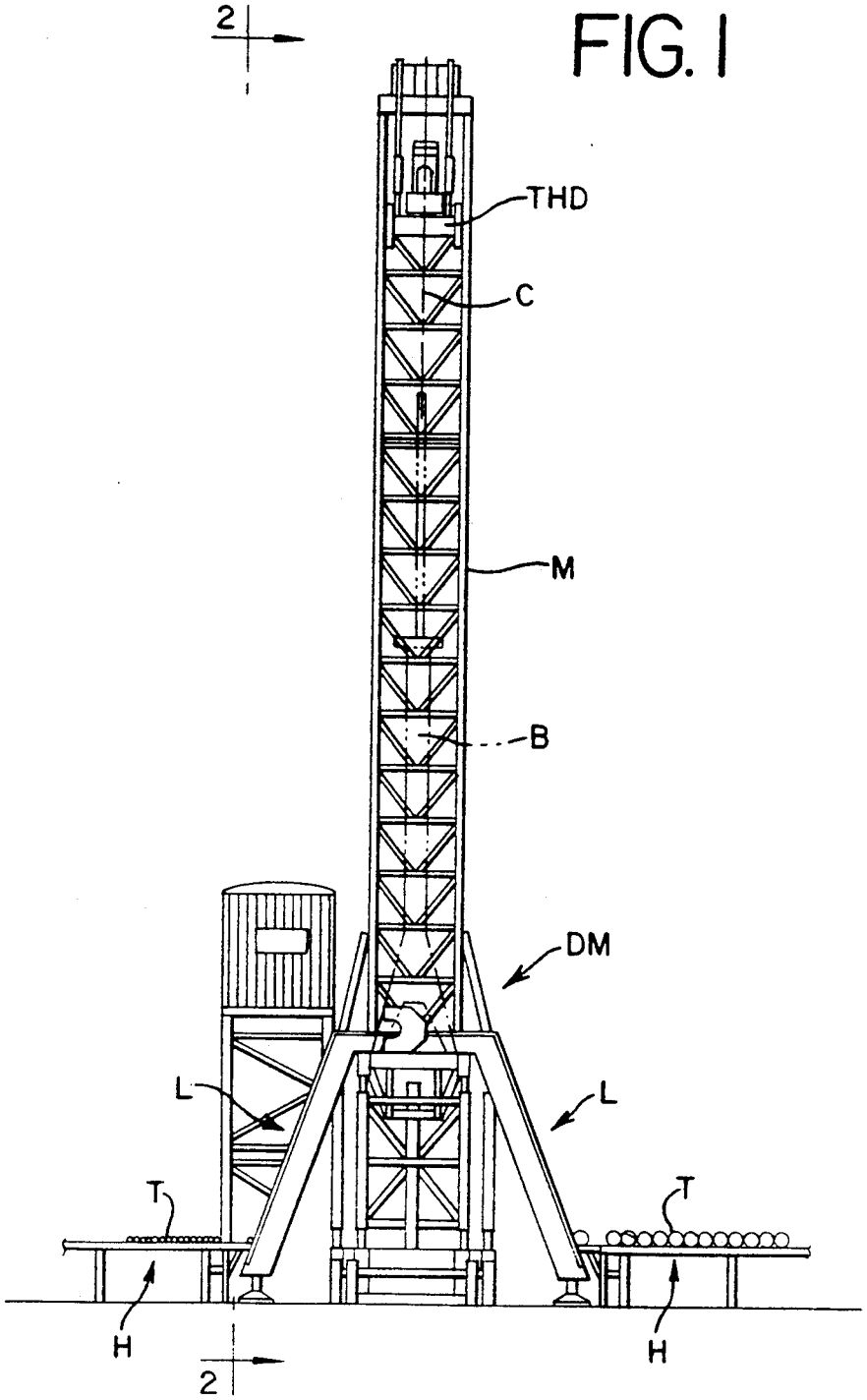
FIG. 1 is an elevational front view of a drilling machine which incorporates a presently preferred embodiment of this invention.
Figure 2:
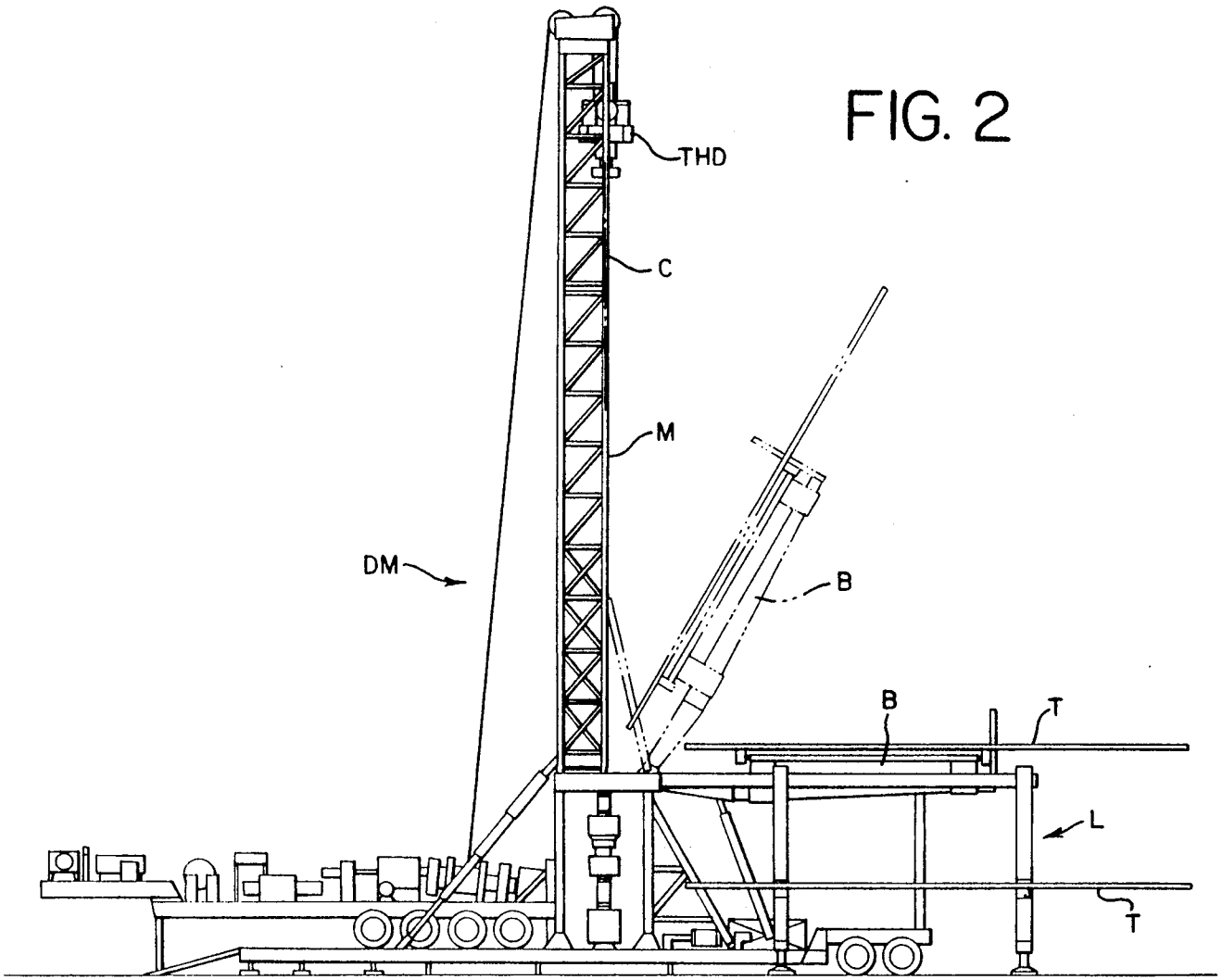
FIG. 2 is a side elevational view of the drilling machine of FIG. 1, taken along line 2—2 of FIG. 1, in which the pipe boom is shown in two alternate positions.

Turning now to the drawings, FIGS. 1 and 2 are general views of a drilling machine DM suitable for use with this invention. The drilling machine DM includes a mast M which defines a drilling centerline C. A top-head drive unit THD is guided for movement along the centerline C. A pipe boom B is provided with clamps and is pivotably mounted to the drilling machine adjacent the drilling floor. The pipe boom is used to grasp a length of a down hole tubular T and to move it between a raised position aligned with the drilling centerline C and a substantially horizontal intermediate level. Tubulars are moved into and out of the clamps of the boom B at the intermediate level. The drilling machine DM is conventional in the features described above, and the operation of such a drilling machine is described in detail for example in U.S. Pat. Nos. 4,708,581 and 4,407,629.

Down hole tubulars are held in position in holding devices H which may for example be conventional pipe racks or containers of various types such as trailers for containing an array of down hole tubulars. The holding devices H are provided with means for controlling movement of individual tubulars onto and off of a lifting device L. The purpose of the lifting device is to translate individual tubulars between a lower horizontal level characteristic of the holding device H and the intermediate horizontal level characteristic of the lower position of the pipe boom B.

As used herein the terms "down hole tubular" and "tubular" are intended to cover a wide range of pipes, tubes and the like used in earth drilling and production operations, including but not limited to drillpipe, collars, casing and production tubing.

The following sections will describe three preferred embodiments 10, 100, 200 of the lifting device L.

The First Preferred Embodiment

Figure 3:
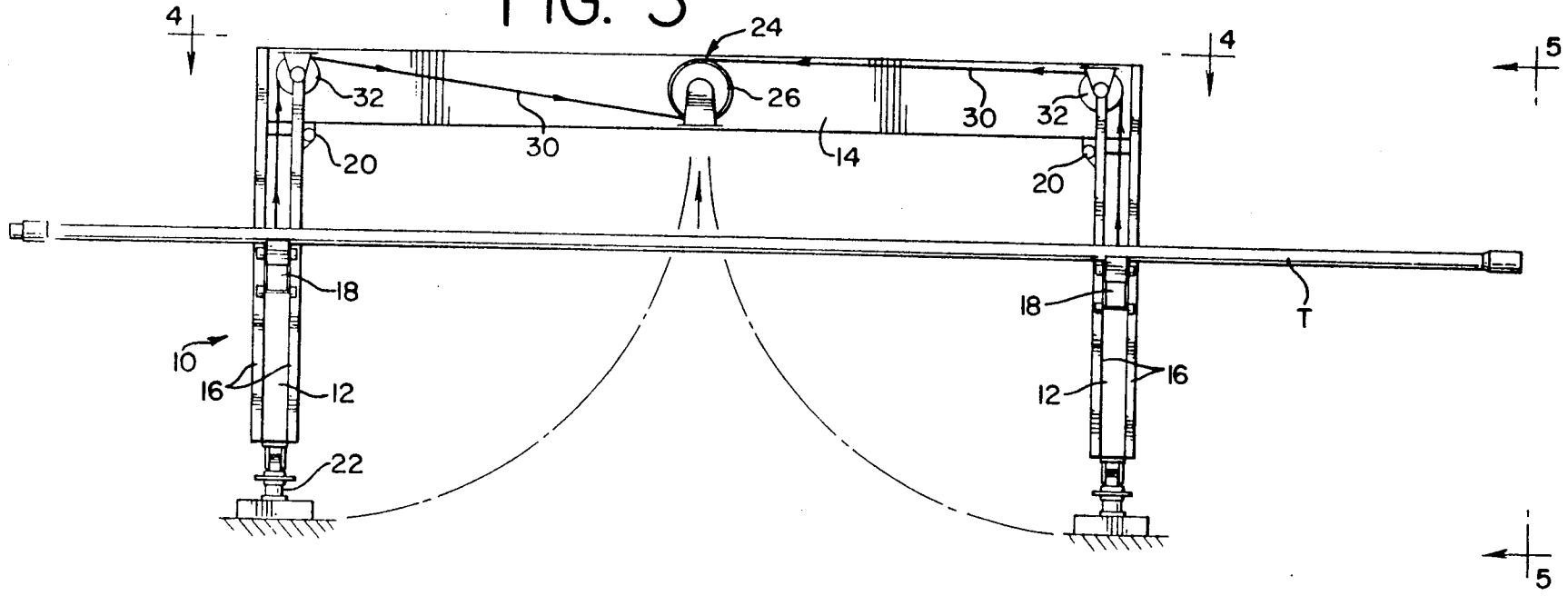
FIG. 3 is a side elevational view of a first embodiment of a lifting device suitable for use with the drilling machine of FIG. 1.
Figure 4:
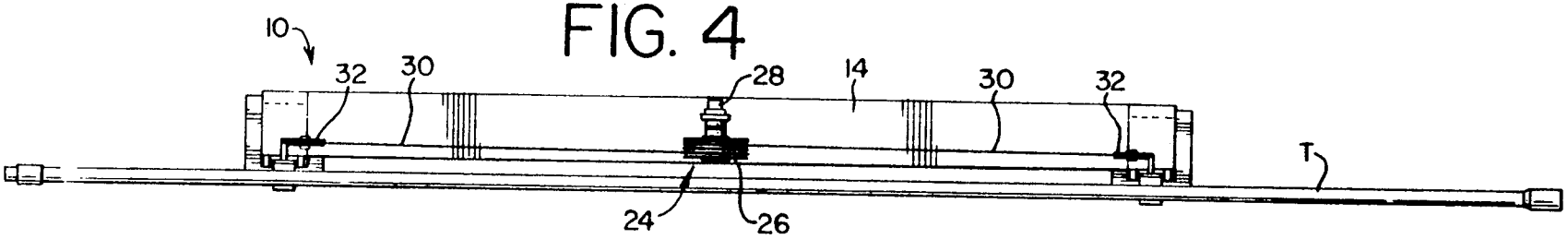
FIG. 4 is a plan view taken along line 4—4 of FIG. 3.
Figure 5:
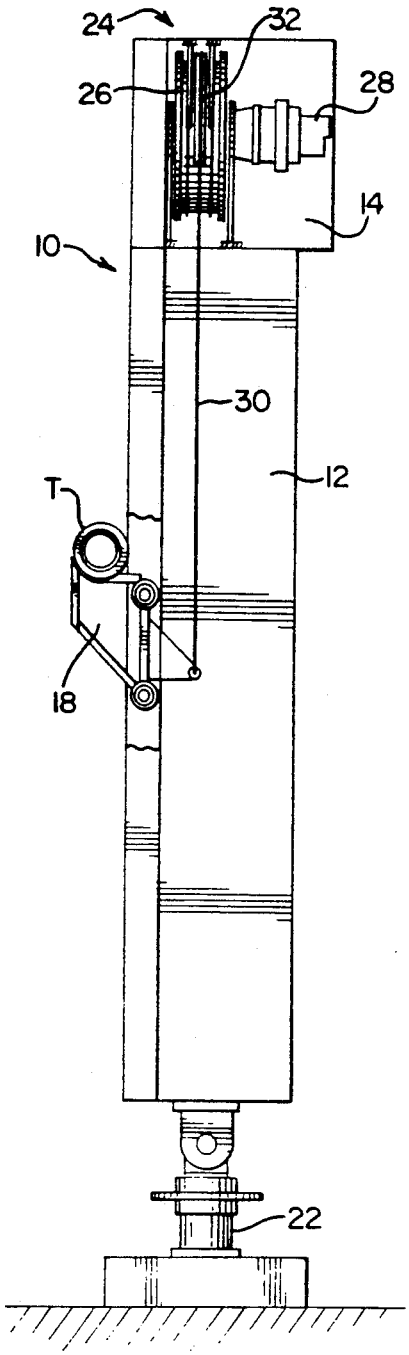
FIG. 5 is a right side elevational view taken along line 5—5 of FIG. 3.

As shown in FIGS. 3 through 5, a tubular lifting device 10 includes two spaced parallel legs 12 which are pivotably connected to a cross-beam 14. Each of the legs 12 defines a pair of spaced parallel tracks 16, and the tracks 16 guide respective dolleys 18 for movement along the tracks 16. Each of the legs 12 is hinged to a respective end of the cross-beam 14 at a hinge axis 20 to allow the legs 12 to be folded adjacent the cross-beam 14 for compact transport and storage. Each of the legs 12 terminates in a leveling base 22.

The lifting device 10 includes a lifting means for lifting the dolleys between a lower position, adjacent the bases 22, and an upper position adjacent an upper surface of the cross-beam 14. This lifting means includes means for positively synchronizing movement of the dolleys 18 to maintain a tubular T horizontal as it raised and lowered by the lifting device 10.

In this embodiment the lifting means includes a hydraulic winch 24. This hydraulic winch 24 includes a drum 26 which is rotated by a hydraulic motor 28 via a conventional planetary gear transmission.

The lifting means 10 also includes means for mechanically linking the winch 24 with both of the dolleys 18. In this embodiment the mechanically linking means includes two tension members 30 such as wire lines. Each of the tension members 30 is secured to the drum 26 and to a respective one of the dolleys 18 via a respective sheave 32. The sheaves 32 are mounted to rotate about a fixed rotational axis on the cross-beam 14. As best shown in FIG. 3, the tension members 30 are coupled to the drum 26 such that rotation of the drum 26 in a first direction raises both of the dolleys 18 by an equal amount, and rotation of the drum 26 in a second, reverse direction lowers each of the dolleys 18 by an equal amount. In this way, the movement of the dolleys 18 is precisely synchronized, thereby ensuring that the tubular T is maintained in a horizontal orientation as it is raised or lowered.

Figure 6:
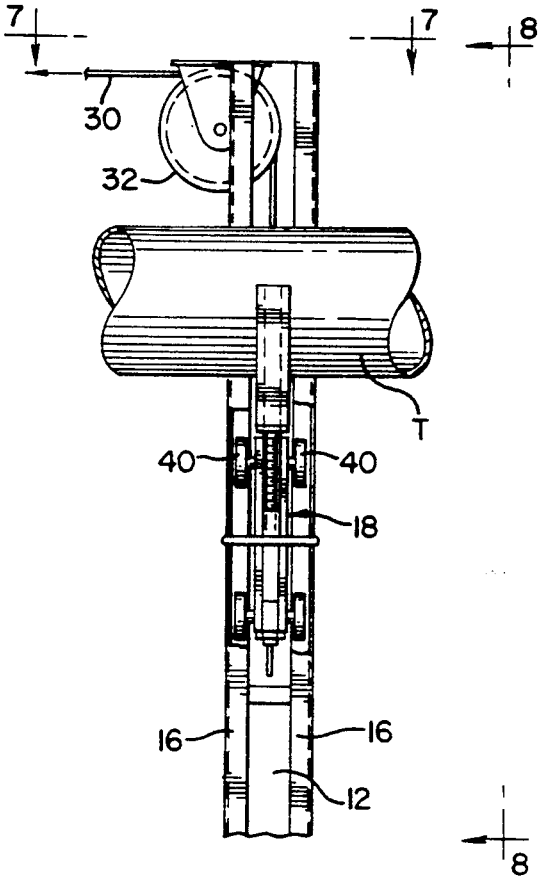
FIG. 6 is an enlarged front view in partial cutaway of a dolley used in the embodiment of FIGS. 3 through 5.
Figure 7:
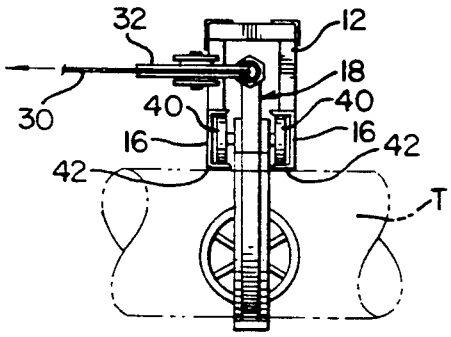
FIG. 7 is a plan view taken along line 7—7 of FIG. 6.

FIGS. 6 though 8 provide further details of construction for the preferred configuration of one of the dolleys 18. As shown in these Figures, each of the dolleys 18 includes four wheels 40 which are captured for movement in respective channels 42 of the tracks 16. The wheels 40 are pivotably mounted to a dolley body 44 which supports a pivot pin 46 and a threaded rod 48. A tubular support 50 is mounted to pivot about the pivot pin 46, and the rest position of the support 50 is defined by the threaded rod 48.

Figure 8:
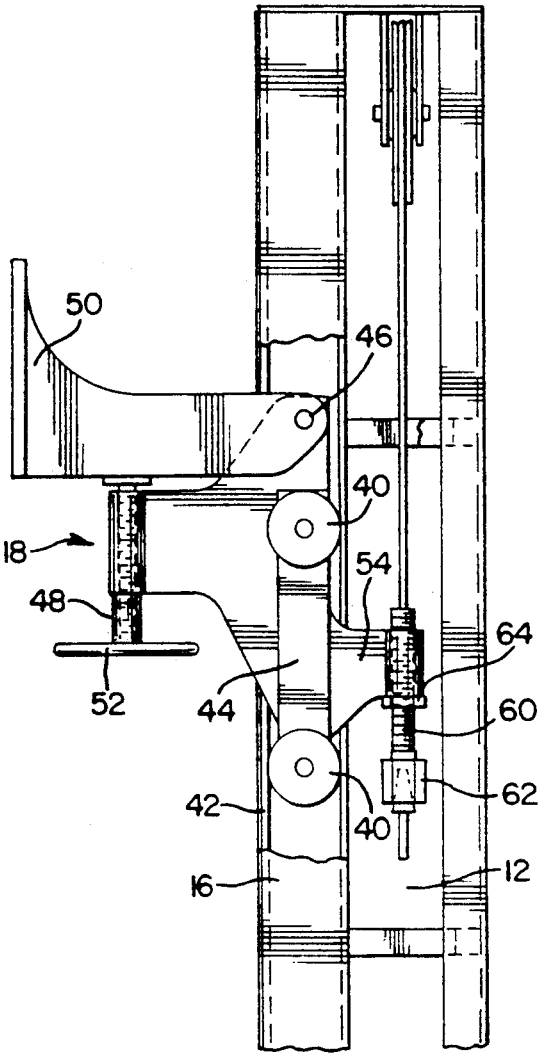
FIG. 8 is an enlarged side view in partial cutaway taken along line 8—8 of FIG. 6.

The threaded rod 48 terminates at its lower end in an adjustment wheel 52 and by rotating the adjustment wheel 52 the support 50 may be tilted to roll a tubular to the left or to the right as shown in FIG. 8. Typically, when the lifting device 10 is being used to raise tubulars for loading into the pipe boom B the support 50 will be tilted with the rod 48 to cause a tubular T to roll to the right as shown in FIG. 8. Conversely, when the lifting device 10 is being used to lower tubulars from the pipe boom onto the holding device H, the support 50 will be tilted to roll tubulars to the left as shown in FIG. 8.

The body 44 also defines an attachment bracket 54 that includes a threaded aperture that receives a threaded sleeve 60. The threaded sleeve receives the tension member 30, which terminates in an anchor 62. The anchor 62 bears against the lower end of the sleeve 60, and by rotating the sleeve 60 in the bracket 54 the dolleys may be leveled with respect to one another. A locking nut 64 locks the sleeve 60 in position once a precise adjustment has been obtained. The lower end of the sleeve 60 is positioned beneath the tubular contacting surface of the support 50 to facilitate raising of the tubular to the intermediate level.

Second Preferred Embodiment

Figure 11:
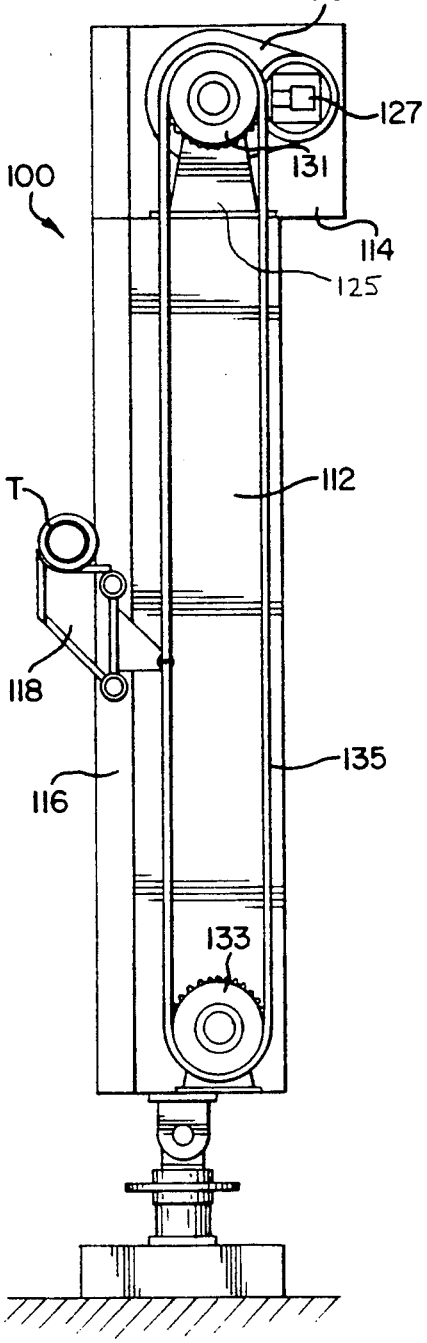
FIG. 11 is a right side elevational view taken along line 11—11 of FIG. 9.
Figure 9:
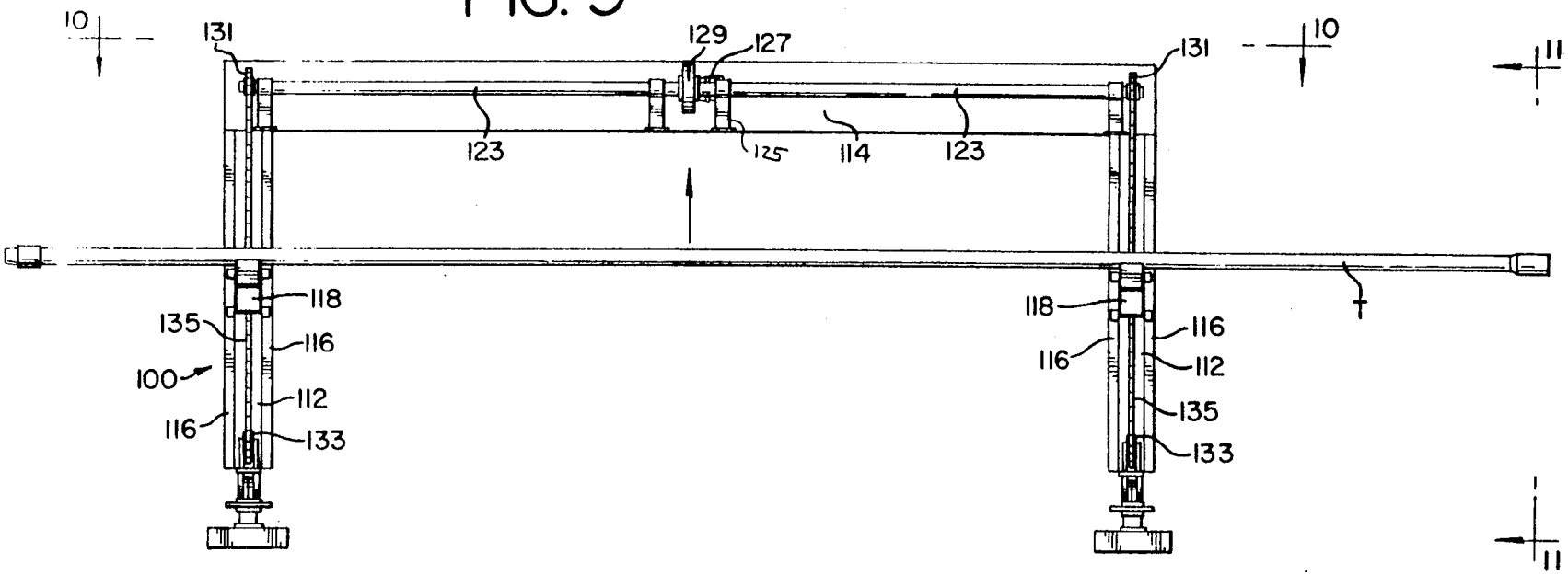
FIG. 9 is a front elevational view of a second preferred embodiment of a lifting device suitable for use with the drilling machine of FIG. 1.
Figure 10:
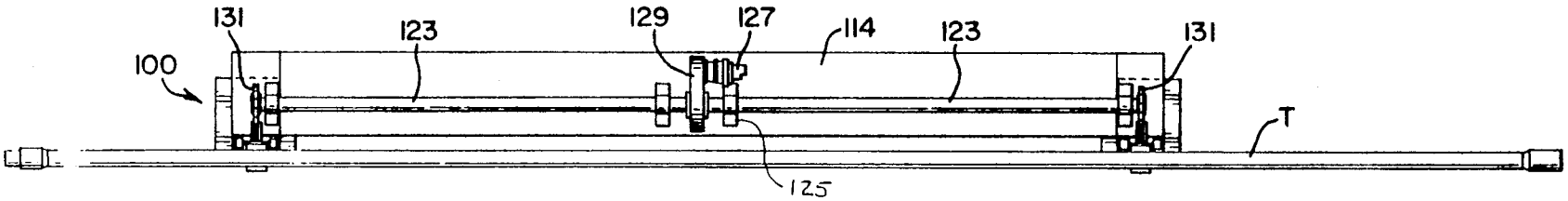
FIG. 10 is a plan view taken along line 10—10 of FIG. 9.

FIGS. 9 through 11 relate to a second lifting device 100 which includes legs 112 and a cross-beam 114 similar to those described above. The legs 112 define channels 116 as described above which support dolleys 118 for movement. The dolleys 118 may be identical to the dolleys 18.

In this embodiment the lifting means comprises a drive shaft 123 which is supported for rotation in the cross beam 114 by journals 125. The drive shaft 123 can be rotated in either direction by a reversible hydraulic motor 127 that is coupled to the drive shaft 123 via a planetary gear and chain case 129. A chain drive sprocket 131 is secured to each end of the drive shaft 123 in alignment with a respective one of the legs 112. Each of the legs defines a chain idler sprocket 133 rotatably mounted at its lower end, and a tension member such as a chain 135 extends in a closed loop between the respective drive sprocket 131 and idler sprocket 133. Each of the dolleys 118 is secured to the respective chain 135 such that the rotation of the drive shaft 123 in a first direction raises the dolleys 118 in a coordinated, synchronized manner, and rotation of the drive shaft 123 in the reverse direction lowers the dolleys 118 in a coordinated, synchronized manner.

Third Preferred Embodiment

FIGS. 12 through 16 relate to a lifting device 200 which represents a third preferred embodiment of the lifting device L shown in FIGS. 1 and 2. The lifting device 200 includes legs 212, a cross-beam 214, tracks 216 and dolleys 218 similar to those described above.

Figure 12:
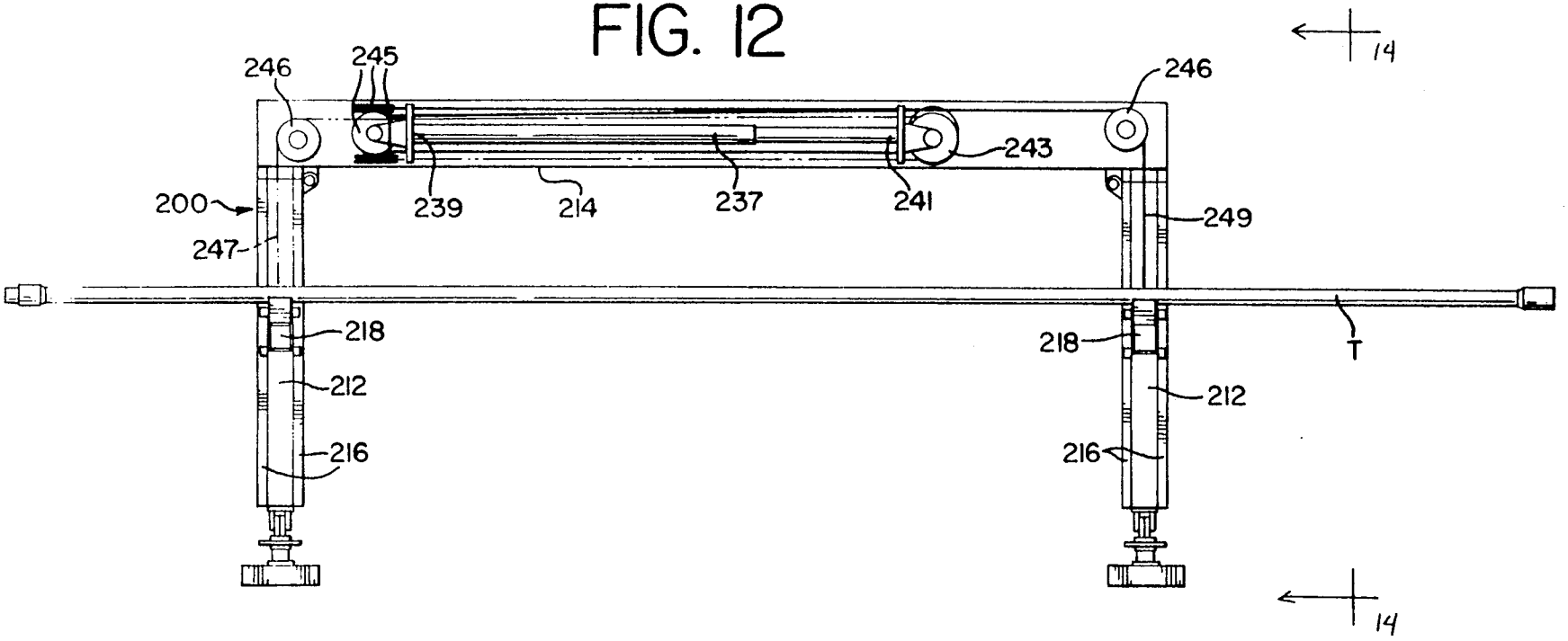
FIG. 12 a front elevational view of a third embodiment of a lifting device suitable for use with the drilling machine of FIG. 1.
Figure 13:
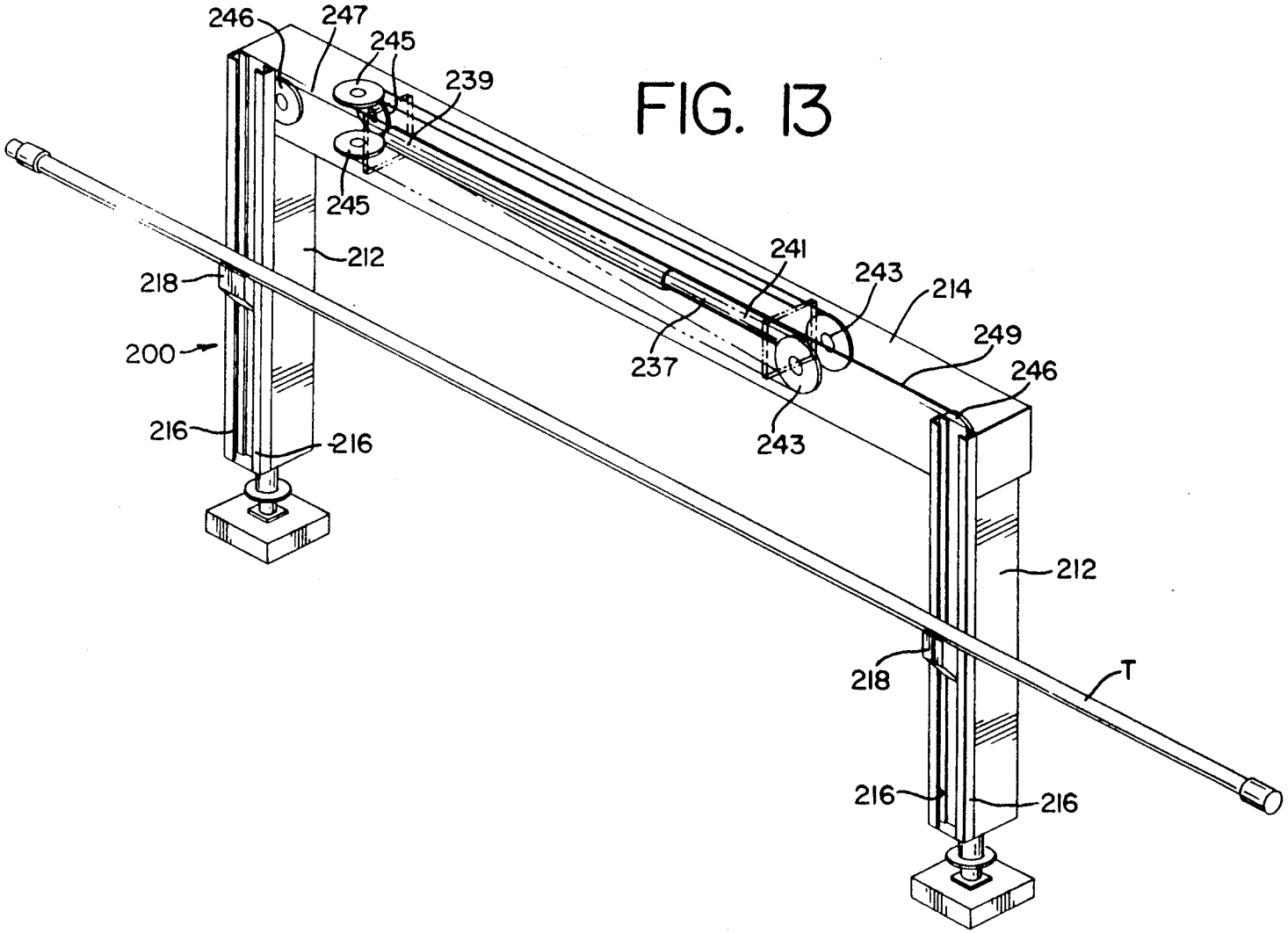
FIG. 13 is an isometric view of a wire-frame model of the lifting device of FIG. 12.

In this embodiment the lifting means comprises a hydraulic cylinder 237 having a fixed end 239 which is fixed in position in the beam 214 and a reciprocating end 241 which moves to the right as the cylinder 237 is extended in the view of FIG. 12. The hydraulic cylinder 237 mounts moving sheaves 243 on the reciprocating end 241 and fixed sheaves 245 on the fixed end 239. Additionally, fixed sheaves 246 are mounted at each end of the beam 214 in alignment with the respective leg 212.

Figure 15:
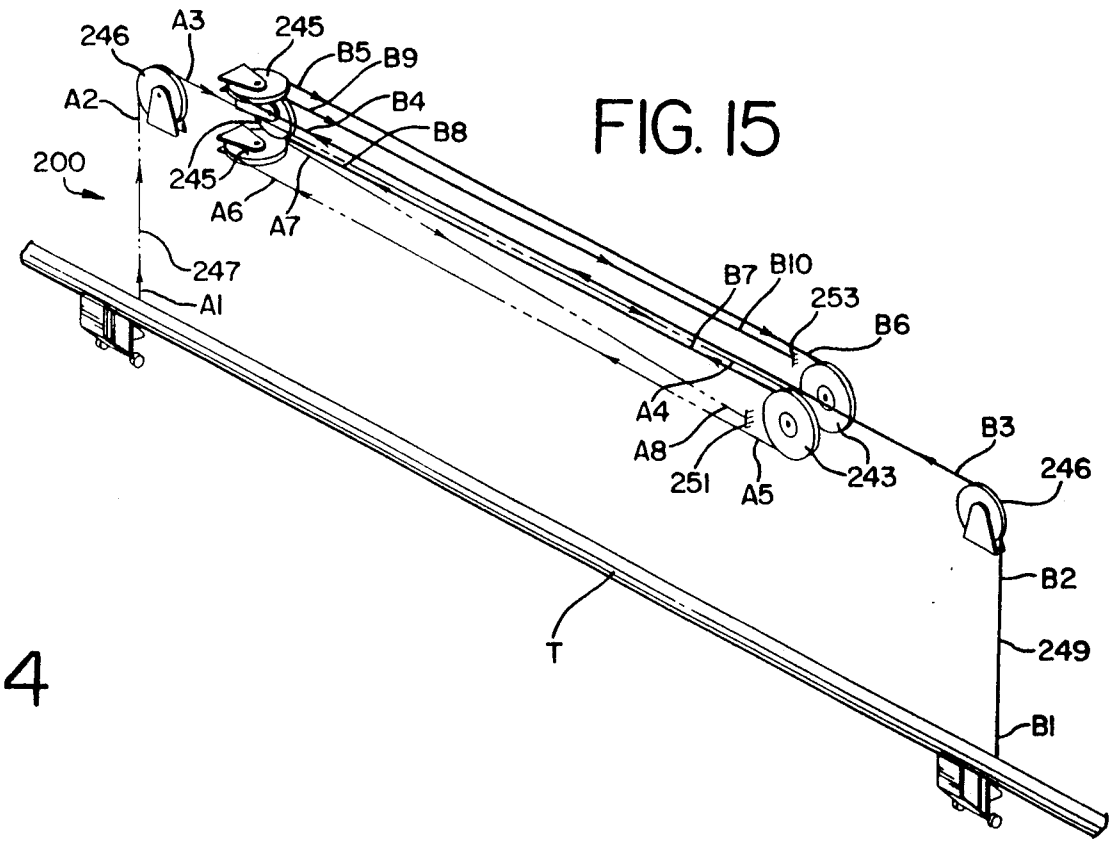
FIG. 15 is an isometric view of the wire-line geometry of the lifting device of FIG. 12.
Figure 14:
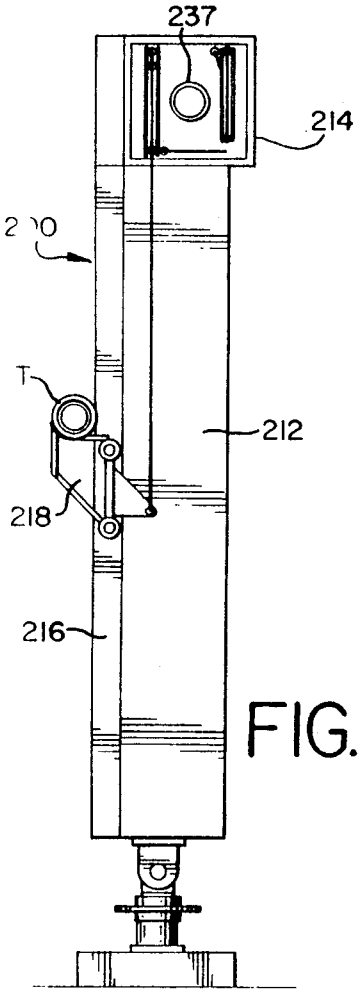
FIG. 14 is a right side elevational view taken along line 14—14 of FIG. 12.

The lifting device 200 includes two tension members such as wire lines 247, 249. Each of the wire lines 247, 249 is connected at one end to a respective one of the dolleys 218 and at the other end to a respective dead end anchor 251, 253 (FIG. 15). Intermediate to these two ends, the wire lines 247, 249 pass over the sheaves 243, 245, 246 as shown in FIG. 15. In FIG. 15 reference symbols A1 through A8 mark eight consecutive points along the length of the wire line 247, and reference symbols B1 through B10 mark ten consecutive points along the length of the wire line 249.

When the hydraulic cylinder 237 is extended, the distance between the moving sheaves 243 and the fixed sheaves 245 is increased, and both of the dolleys 218 are raised by an equal amount. Conversely, when the hydraulic cylinder 237 is retracted, the distance between the fixed sheaves 245 and the moving sheaves 243 is reduced, and the dolleys 218 are lowered each by an equal amount.

From the foregoing it should be apparent that the lifting devices 10, 100, 200 all use a single actuator (the winch 24, the motor 127 and drive shaft 123, and the hydraulic cylinder 237) which is mechanically connected to the dolleys 18, 118, 218 by tension members 30, 135, 247, 249 in such a way that movement of the single actuator is transmitted in a synchronized manner to both of the dolleys. This causes the two dolleys to move together along the tracks, thereby maintaining a tubular T supported by the dolleys in a horizontal orientation. Because only a single actuator is used, the need for complex systems to control multiple actuators to move in parallel is completely eliminated. In each case, the linkage is relatively simple, reliable and easily serviced by oil field personnel.

Of course, it should be understood that a wide range of changes and modifications can be made to the preferred embodiments described above. For example, the legs 12, 112, 212 may be either vertical or slightly inclined, but they should be maintained parallel. In some alternative embodiments it may be preferable to use two synchronized actuators such as hydraulic cylinders, each equipped with a sensor such as a linear variable differential transformer and a suitable controller to synchronize movements of the two cylinders in a closed loop servo system. In this arrangement one actuator may be placed in each substantially vertical leg of the lifter.

It is therefore intended that the foregoing detailed description be regarded as illustrative rather than limiting, and that it be understood that it is the following claims, including all equivalents, which are intended to define the scope of this invention.

I claim:

1. In combination with an earth drilling machine of the type comprising a boom for moving a down hole tubular from a horizontal position at an intermediate level to a raised position aligned with a drilling axis; a tubular holding device for holding down hole tubulars horizontally at a lower level, beneath the intermediate level; and a lifting device comprising: first and second spaced, parallel tracks oriented to extend substantially from the lower level to substantially the intermediate level; first and second dolleys, each guided for movement along a respective one of the tracks and configured to retain the down hole tubular; the improvement comprising:

lifting means for moving the dolleys between the lower and intermediate levels to transfer the tubular between lower and intermediate levels;

means, included in the lifting means, for positively synchronizing movement of the dolleys along the tracks to maintain the tubular horizontal as the tubular is moved between the lower and intermediate levels; and a cross beam interposed between the first and second tracks, said cross beam defining a longitudinal extent;

a plurality of hinges mounted between the cross beam and the tracks such that each of the tracks is hinged to a respective portion of the cross beam, said hinges oriented transverse to the longitudinal extent to allow the tracks to be folded toward each other adjacent the cross beam for compact transport and storage.

2. The invention of claim 1 wherein the lifting means comprises a lifting actuator, and wherein the synchronizing means comprises means for mechanically linking the lifting actuator with both the first and second dolleys such that the lifting actuator moves both the first and second dolleys.

3. The invention of claim 2 wherein the mechanically linking means comprises two tension members, each extending between the lifting actuator and a respective one of the dolleys to transmit motion of the lifting actuator to the dolleys.

4. The invention of claim 3 wherein the lifting actuator comprises a winch, and wherein each of the tension members is coupled to the winch such that movement of the winch causes movement of each of the dolleys.

5. The invention of claim 3 wherein the lifting actuator comprises a hydraulic cylinder having a fixed end and a reciprocating end, and wherein each of the tension members is coupled to the reciprocating end such that movement of the reciprocating end causes movement of each of the dolleys.

6. The invention of claim 3 wherein a portion of each of the dolleys defines a respective tubular support surface, and wherein the dolleys are coupled to the respective tubular support surface at locations below the respective tubular support surfaces.

7. The invention of claim 1 wherein the lifting means is mounted to the cross beam.

8. The invention of claim 4 wherein the winch comprises a drum rotatable about an axis oriented transversely to the cross beam, and wherein the tension members extend from opposite sides of the drum toward respective ends of the cross beam.

9. In combination with an earth drilling machine of the type comprising a boom for moving a down hole tubular from a horizontal position at an intermediate level to a raised position aligned with a drilling axis; a tubular holding device for holding down hole tubulars horizontally at a lower level, beneath the intermediate level; and a lifting device comprising: first and second spaced, parallel tracks oriented to extend substantially from the lower level to substantially the intermediate level; first and second dolleys, each guided for movement along a respective one of the tracks and configured to retain the down hole tubular; the improvement comprising:

lifting means for moving the dolleys between the lower and intermediate levels to transfer the tubular between lower and intermediate levels;

means, included in the lifting means, for positively synchronizing movement of the dolleys along the tracks to maintain the tubular horizontal as the tubular is moved between the lower and intermediate levels;

wherein the lifting means comprises a lifting actuator, and wherein the synchronizing means comprises means for mechanically linking the lifting actuator with both the first and second dolleys such that the lifting actuator moves both the first and second dolleys;

wherein the mechanically linking means comprises two tension members, each extending between the lifting actuator and a respective one of the dolleys to transmit motion of the lifting actuator to the dolleys;

wherein the lifting actuator comprises a winch, and wherein each of the tension members is coupled to the winch such that movement of the winch causes movement of each of the dolleys; and wherein the winch comprises a drum rotatable about an axis oriented transversely to a line extending between the tracks, and wherein the tension members extend from opposite sides of the drum toward respective ones of the tracks.

10. The invention of claim 9 wherein a portion of each of the dolleys defines a respective tubular support surface, and wherein the dolleys are coupled to the respective tubular support surfaces at locations below the respective tubular support surfaces.

* * * * *